US006325496B1

(12) United States Patent
Kageyama et al.

(10) Patent No.: US 6,325,496 B1
(45) Date of Patent: Dec. 4, 2001

(54) INK-JET PRINTING APPARATUS

(75) Inventors: Tetsuto Kageyama, Chigasaki; Toshihiro Sasaki, Yokohama, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/550,899

(22) Filed: Apr. 17, 2000

(30) Foreign Application Priority Data

| | | |
|---|---|---|
| Apr. 26, 1999 | (JP) | 11-118722 |
| Aug. 12, 1999 | (JP) | 11-228926 |
| Mar. 21, 2000 | (JP) | 12-078813 |

(51) Int. Cl.[7] ..... B41J 2/175
(52) U.S. Cl. ..... 347/85
(58) Field of Search ..... 347/85, 86, 87, 347/89, 92, 30

(56) References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 5,367,328 * | 11/1994 | Erickson | 347/7 |
| 5,489,932 * | 2/1996 | Ceschin et al. | 347/87 |

FOREIGN PATENT DOCUMENTS

| | | |
|---|---|---|
| 947 328 * | 10/1999 | (EP) . |
| 54-056847 | 5/1979 | (JP) . |
| 59-123670 | 7/1984 | (JP) . |
| 59-138461 | 8/1984 | (JP) . |
| 60-071260 | 4/1985 | (JP) . |

* cited by examiner

*Primary Examiner*—N. Le
*Assistant Examiner*—Michael Nghiem
(74) *Attorney, Agent, or Firm*—Fitzpatrick, Cella, Harper & Scinto

(57) ABSTRACT

An ink-jet printing apparatus can maintain a liquid level height in an ink storing portion in an air buffering vessel at a predetermined height and can simplify an associated mechanism for connection between a scanning carriage and a stationary ink tank while a low cost single tube is employed. An air buffering vessel of the ink-jet printing apparatus has one ink supply opening from the ink storage tank and at least two suction and discharge openings located at mutually different height in a vertical direction. Upper opening of the at least two suction and discharge openings serves for air suction and discharge. Lower opening serves for ink supply and discharge, and is communicated with a connection opening of the printing head.

7 Claims, 10 Drawing Sheets

INK-JET PRINTING APPARATUS

This application is based on patent application Ser. Nos. 11-118722 (1999) filed Apr. 26, 1999 in Japan, 11-228926 (1999) filed Aug. 12, 1999 in Japan and 2000-078813 (2000) filed Mar. 21, 2000 in Japan, the content of which is incorporated hereinto by reference.

BACKGROUND OF THE INVENTION

1. Field of the Invention

The present invention relates generally to an ink-jet printing apparatus. More particularly, the invention relates to an ink-jet printing apparatus which has an air buffering vessel in an ink supply system supplying an ink to a printing head.

2. Description of the Related Art

Nowadays, various printing systems have been developed as printing apparatus. Amongst, an ink-jet printing system has been widely employed for superiority in gentleness, capability of high speed and high density printing for non-contacting with a printing medium, and easiness of colorization and down-sizing.

One system of the conventional ink-jet printing apparatus is constructed to reciprocate a printing head mounted on a carriage and perform printing on the printing medium by ejecting an ink from the printing head. In such conventional ink-jet printing apparatus, it is necessary to increase capacity of an ink tank in order to reduce frequency of exchanging of the ink tank. However, an integral type of the printing head and the ink tank, when the capacity of the ink tank is increased, inertial mass on the carriage is inherently increased. Therefore, in order to avoid increasing of inertial mass, the ink tank is arranged at stationary or fixed position without requiring movement and supplies the ink to the printing head on the carriage through a tube or the like by means of various pumps.

On the other hand, in the ink-jet printing apparatus, for avoiding dripping of ink from the printing head except for driving for printing, the inside of the printing head is constantly maintained in a slight negative pressure state lower than an atmospheric pressure. By this, ejection upon driving for printing and prevention of unnecessary dripping other than driving for printing can be achieved.

However, when the carriage is moved reciprocally in the ink-jet printing apparatus for printing, the ink within the tube connecting the printing head and the ink tank flows to cause fluctuation of an ink ejection amount by pushing out and pulling back the ink within the printing head, resulting in fluctuation of printing or ejection failure.

Accordingly, as a measure for such fluctuation of printing or ejection failure, there has been known a technology, in which an air buffering vessel having an air storing portion is arranged between the tube and the printing head in the vicinity of the printing head for buffering pressure variation due to flow of the ink within the tube utilizing elastic property of the air to stabilize ejection.

Such an air buffering vessel defines an air storing portion in the upper portion and an ink storing portion in the lower portion thereof. The air storing portion also has a function for separating air from the ink admixing the air within the tube to accumulate within the air storing portion for feeding only ink to the printing head. Accordingly, so as to avoid penetration of the air into the printing head from the ink storing portion due to waving of a liquid level of the ink storing portion by reciprocal motion of the carriage, the height of the liquid level in the ink storing portion has to be maintained at a predetermined height.

On the other hand, even in an ink-jet printing apparatus of the type performing printing by feeding a printing medium without moving a carriage, namely a printing head, a similar vessel is arranged for separating the air admixed in the ink. The internal ink storing portion in the vessel is required to certainly maintain the height of the liquid level at the predetermined height for the purpose of air separation in either of the carriage scanning type and the stationary printing head type printing apparatus.

However, the height of the liquid level tends to be gradually lowered due to penetration of air from a tube wall surface or degassing of dissolved gas in the ink. Therefore, in order to continuously maintain the predetermined liquid level height, there is a known method, in which two tubes are used to connect one ends of respective tubes to the bottom surface position and the predetermined liquid level height position of the ink storing portion respectively and the other ends to a separate stationary ink tank to circulate the ink by the pump.

However, in the conventional method for maintaining the liquid level height using two tubes, number of tubes connecting the printing head mounted on the carriage and the stationary ink tank which is not movable, must be increased. Particularly, in the case of a color printer of a plurality of colors, problems that an arrangement of the tubes becomes complicate, a driving resistance of the carriage due to increasing of stiffness increases and the parts assembling cost elevates, can be encountered.

The foregoing problems will not be encountered when using a single tube having low air permeability. However, at present, an appropriate material having no air permeability in the tube having bending ability and flexibility, is hardly available. Accordingly, it is difficult to maintain the predetermined liquid level height over a long period of time without liquid level height adjusting function employing a single low cost tube.

SUMMARY OF THE INVENTION

The present invention has been worked out for solving the problems in the prior art. It is therefore an object of the present invention to provide an ink-jet printing apparatus which can maintain a liquid level height in an ink storing portion in an air buffering vessel at a predetermined height and can simplify an associated mechanism for connection between a scanning carriage and a stationary ink tank while a low cost single tube is employed.

It is another object of the present invention to provide an ink-jet printing apparatus having a pressure reduction vessel which can prevent ejection failure due to carriage scanning and prevent penetration of air into a printing head.

A further object of the present invention is to provide an air buffering vessel or a pressure reduction vessel which can maintain a liquid level height in an ink storing portion at a predetermined height and prevent penetration of air into a printing head.

In order to accomplish the above-mentioned objects, in a first aspect of the present invention, there is provided an ink-jet printing apparatus comprising:

means for printing on a printing medium by ejecting an ink from a printing head with varying relative position between the printing head and the printing medium by either of scanning the printing head or feeding the printing medium;

an ink storage tank disposed at a position not being interfered by scanning of the printing head or feeding of the printing medium;

an air buffering vessel connected to the printing head; and means for supplying the ink to the printing head from the ink storage tank through the air buffering vessel, wherein the air buffering vessel has one ink supply opening from the ink storage tank and at least two suction and discharge openings located at mutually different height in a vertical direction, an upper opening of the at least two suction and discharge openings is constructed for air suction and discharge, a lower opening of the at least two suction and discharge openings is constructed for ink supply and discharge, and the upper opening and the lower opening are communicated with a connection opening to the printing head.

Here, an ink-jet printing apparatus may assume that flow resistances of the one ink supply opening, the upper opening and the lower opening of the air buffering vessel may be Rt, Ra and Ri, respectively, a relationship of three flow resistances may be Ra<Rt<Ri.

The flow resistance may be set by at least one flow rate restricting filter member.

At least one of the flow resistances may be set by a flow rate restricting movable lid which is in open position when ink does not flow and printing is effected, and is in closed position upon suction from the printing head side.

The air buffering vessel may have a T-shaped branching pipe member therein, one end of the T-shaped branching pipe serves as the upper opening, another end serves as the lower opening, and the other end serves as the connection opening to be connected to the printing head.

The lower opening may be provided with a filter member for providing large suction resistance.

The lower opening may be formed with a conduit having a smaller internal diameter in comparison with the upper opening for providing large suction resistance.

The air buffering vessel may have a vessel body having one ink supply opening connected to the ink storage tank and upper and lower openings located at mutually different height in a vertical direction, and a communication member provided outside of side surface of the vessel body and communicating the upper and lower openings with the connection opening to the printing head.

In a second aspect of the present invention, there is provided an ink-jet printing apparatus comprising:

means for printing on a printing medium by ejecting an ink from a printing head with varying relative position between the printing head and the printing medium by either of scanning the printing head or feeding the printing medium;

an ink storage tank disposed at a position not being interfered by scanning of the printing head or feeding of the printing medium;

a pressure reducing vessel connected to the printing head; and means for supplying the ink to the printing head from the ink storage tank through the pressure reducing vessel, wherein the pressure reducing vessel has at least two air chambers mutually communicated by an upper communication opening and a lower communication opening, an ink supply opening from the ink storage tank and a connection opening to the printing head are respectively arranged in different air chambers of the at least two air chambers, the ink supply opening is located at a position lower than the upper communication opening and higher than the connection opening, and ink suction resistances of the lower communication opening and the ink supply opening are set to be greater than an air suction resistance of the upper communication opening.

Here, an ink-jet printing apparatus may further comprise a portion having an internal diameter less than or equal to 2 mm within a path from the ink storage tank through the pressure reducing vessel, and wherein an opening area of the upper communication opening may be greater than or equal to 3.1 $mm^2$.

An opening area of the lower communication opening of the pressure reducing vessel may be more than or equal to 0.8 $mm^2$ and less than or equal to 10 $mm^2$.

The lower communication opening of the pressure reducing vessel may be arranged at lower position than the connection opening or an ink flow opening of a member connected thereto.

The pressure reducing vessel may be constructed with a vessel body having an enclosed interior separated into a first air chamber and a second air chamber, the upper communicating opening may be provided at the uppermost position of the first air chamber and the lower communication opening may be provided at the lowermost portion of the first air chamber, and the printing head may be mounted on the lower portion of the vessel body.

The pressure reducing vessel may be constructed with a vessel body separated into a first air chamber and a second air chamber by a cylindrical wall formed therein, the upper communication opening may be formed at the uppermost portion of the cylindrical wall and the lower communication opening may be formed at the lowermost portion, the ink supply opening opened to the first air chamber may be provided at an intermediate position of the vessel body, and the connection opening may be formed in the bottom portion of the second air chamber, the printing head may be mounted on the lower portion of the vessel body via a connection member in a condition where a filter portion of the printing head may be arranged in the connection opening.

The printing head may have nozzles, a head cap may be arranged opposing to the nozzles at a home position, and the head cap may be connected to a pressure reduction pump.

The pressure reducing vessel may be constructed with a vessel body separated into a first air chamber and a second air chamber by a partition member formed therein, the upper communicating opening may be provided at an upper portion of the pertition member and the lower communication opening may be provided at a lower portion of the pertition member, the ink supply opening may be provided in the first air chamber and the connection opening may be provided in the second air chamber.

The printing head may have an electrothermal transducer for generating thermal energy for ink ejection, and may have a structure for ejecting the ink from ejection openings utilizing film boiling caused in the ink by thermal energy applied by the electrothermal transducer. 18. In the third aspect of the present invention, there is provided an air buffering vessel, comprising:

one ink supply opening to be connected to an external ink storage tank and two suction and discharge openings located at mutually different height in a vertical direction, an upper opening of the two suction and discharge openings being constructed for air suction and discharge, a lower opening of the two suction and discharge openings being constructed for ink supply and discharge, and the upper opening and the lower opening being to be communicated with a printing head.

Here, an air buffering vessel may assume that flow resistances of the one ink supply opening, the upper opening and the lower opening may be Rt, Ra and Ri, respectively, a relationship of three flow resistances may be Ra<Rt<Ri.

In a fourth aspect of the present invention, there is provided a pressure reducing vessel comprising two air chambers mutually communicated by an upper communication opening and a lower communication opening, an ink supply opening from an external ink storage tank and a connection opening to a printing head being respectively arranged in different air chambers of the two air chambers, the ink supply opening being located at a position lower than the upper communication opening and higher than the connection opening, and ink suction resistances of the lower communication opening and the ink supply opening being set to be greater than an air suction resistance of the upper communication opening.

Throughout the disclosure, the wording "print" is used in the meaning not only the case of forming meaningful information, such as character, graphic image and so on but also including formation of image, design or pattern on the printing medium in a broad sense and processing of the medium irrespective whether is meaningful or not and whether visibly perceptible or not in human eye.

Here, the wording "printing medium" not only represents a sheet of paper as typically used in the printing apparatus but also includes any media which can receive ink, such as a cloth, a plastic film, a metal plate and so on.

Furthermore, the wording "ink" has to be understood in a broad sense like the wording of "print", and represents any liquid which can form character, image, design, pattern and so on by application on the printing medium or can be provided for processing of the printing medium.

On the other hand, the wording "nozzle", as long as not particularly defined in the disclosure, generally represents an ejection opening, a liquid passage communicated thereto and an element for generating energy to be utilized for ink ejection.

With the ink-jet printing apparatus according to the present invention, in order to maintain the liquid level height in the ink storing portion in the air buffering vessel, by employing opening portions having mutually different flow resistances in combination, placing the opening portion having the smallest flow resistance at higher position than the predetermined liquid level height, and sucking from the printing head side, an greater amount of air can be sucked from the air storing portion for increasing the ink in the ink storing portion. Accordingly, even in the ink-jet printing apparatus, in which the air buffering vessel and the ink storage tank are connected with only one tube, it becomes possible to adjust the liquid level height in the air buffering vessel for elevation. Thus, the mechanism associated with connection between the scanning carriage and the stationary ink storage tank can be simplified.

On the other hand, in another aspect of the ink-jet printing apparatus according to the present invention, in order to maintain the liquid level height of the ink storing portion of the pressure reduction vessel, the opening portions having different ink/air suction resistances are employed in combination. The pressure reduction vessel defining at least two gas chambers therein is sucked for pressure reduction from the side of the printing head connected to the lower connection opening of the pressure reduction vessel at a predetermined flow velocity and timing to suck greater amount of air from the upper air storing portion of the pressure reducing vessel which is lowered the liquid level height due to penetration of air. Accordingly, even in the ink-jet printing apparatus, in which the pressure reducing vessel and the ink storage tank are connected with only one tube, the liquid level height can be certainly elevated, and the mechanism associated with connection between the scanning carriage and the stationary ink storage tank can be simplified.

The above and other objects, effects, features and advantages of the present invention will become more apparent from the following description of embodiments thereof taken in conjunction with the accompanying drawings.

DETAILED DESCRIPTION OF THE PREFERRED EMBODIMENT

The preferred embodiment of the ink-jet printing apparatus according to the present invention will be explained hereinafter in detail with reference to the drawings.

Figure 1:
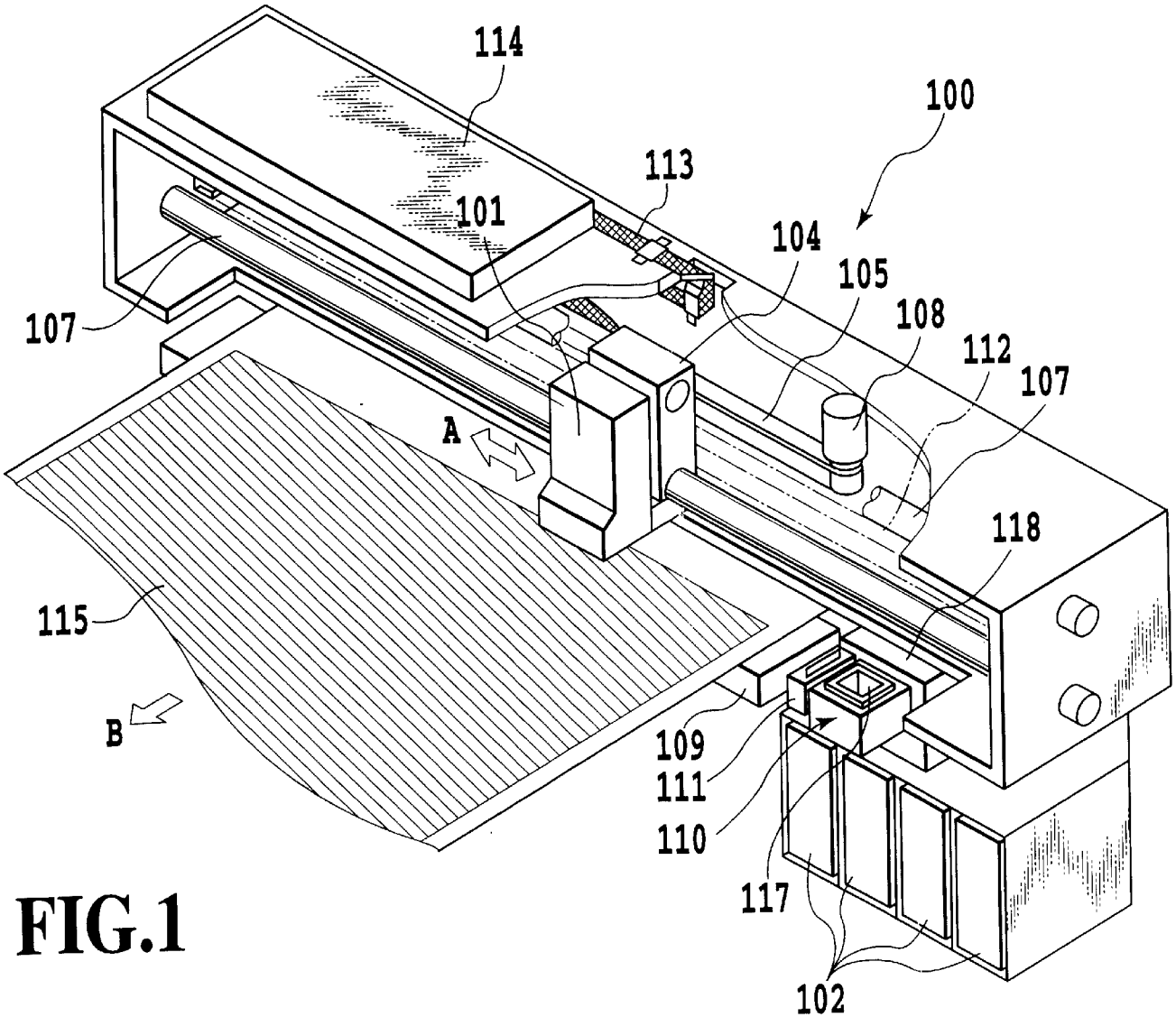
FIG. 1 is a partially cut out perspective view showing a major part of an ink-jet printing apparatus according to the present invention.

FIG. 1 is a partially cut out perspective view showing a major part of an ink-jet printing apparatus according to the present invention. An ink-jet printing apparatus 100 has a carriage 104 which is supported on guide rails 107 arranged within a frame in parallel relationship with each other, for reciprocal motion in a direction of arrow A. The carriage 104 is connected to a timing belt 105 so as to be reciprocally scanned in the direction of arrow A by driving the timing belt 105 by means of a motor 108. On the carriage 104, an ink ejecting portion 101 including a plurality of printing heads corresponding to respective colors of cyan, yellow, magenta and black and so on, for example, is detachably mounted.

Each printing head has a plurality of nozzles. In each nozzle, an electrothermal transducer or an electric/pressure transducer generating energy for ink ejection. To the printing head, an ink is supplied by capillary phenomenon in the nozzle. The ink forms meniscus on a surface where the nozzle opens (hereinafter referred to as "nozzle surface") to be maintained in a condition filling the nozzle. By supplying power to the electrothermal transducer or the electric/pressure transducer under this condition, the ink is ejected. It should be noted that a driving substrate of the printing head is connected to a control box 114 controlling overall operation of the ink-jet printing apparatus 100 via a flat cable 113.

At the position opposing to the printing head of the ink ejecting portion 101, a platen 109 is provided. A printing paper 115 is fed in a direction of arrow B on the platen 109. The printing paper 115 is intermittently fed per a predetermined pitch at every scan of the carriage 104. In the stationary condition of the printing paper 115, the ink is ejected from the printing head to perform printing. Within a scanning region of the printing head and outside of the region of the printing paper 115, a head recovery system 110 for maintaining the ink ejection performance of the printing head in good condition, is arranged in opposing relationship with the printing head. The head recovery system 110 has a blade 111 for wiping and cleaning the nozzle surface of the printing head, and a cap 117 for capping the printing head. The cap 117 is communicated with a suction pump 118 and is constructed for sucking the ink or the like from the nozzle of the printing head. It should be noted that a position where the printing head is placed in opposition to the cap is referred to as a home position.

The ink ejecting portion 101 incorporates a plurality of air buffering vessels or pressure reduction vessels respectively corresponding to a plurality of printing heads. The air buffering vessel or the pressure reducing vessel has an ink storing portion temporarily storing the ink to be supplied to the printing head. Reference numeral 102 denotes a plurality of ink storage tanks arranged at stationary or fixed position below the ink-jet printing apparatus 100 and corresponding to a plurality of printing heads and air buffering vessels. Each ink storage tank 102 is connected to each air buffering vessel through a supply tube and has a greater volume than the air buffering vessel. Furthermore, the ink storage tank 102 is constructed with a flexible material container (for example, a bag having flexibility) for deformation associating with reduction of ink stored therein. It should be noted that the supply tube is covered with a protection member 112 together with the flat cable 113 and thus is not visible in FIG. 1.

(First Embodiment)

Figure 2:
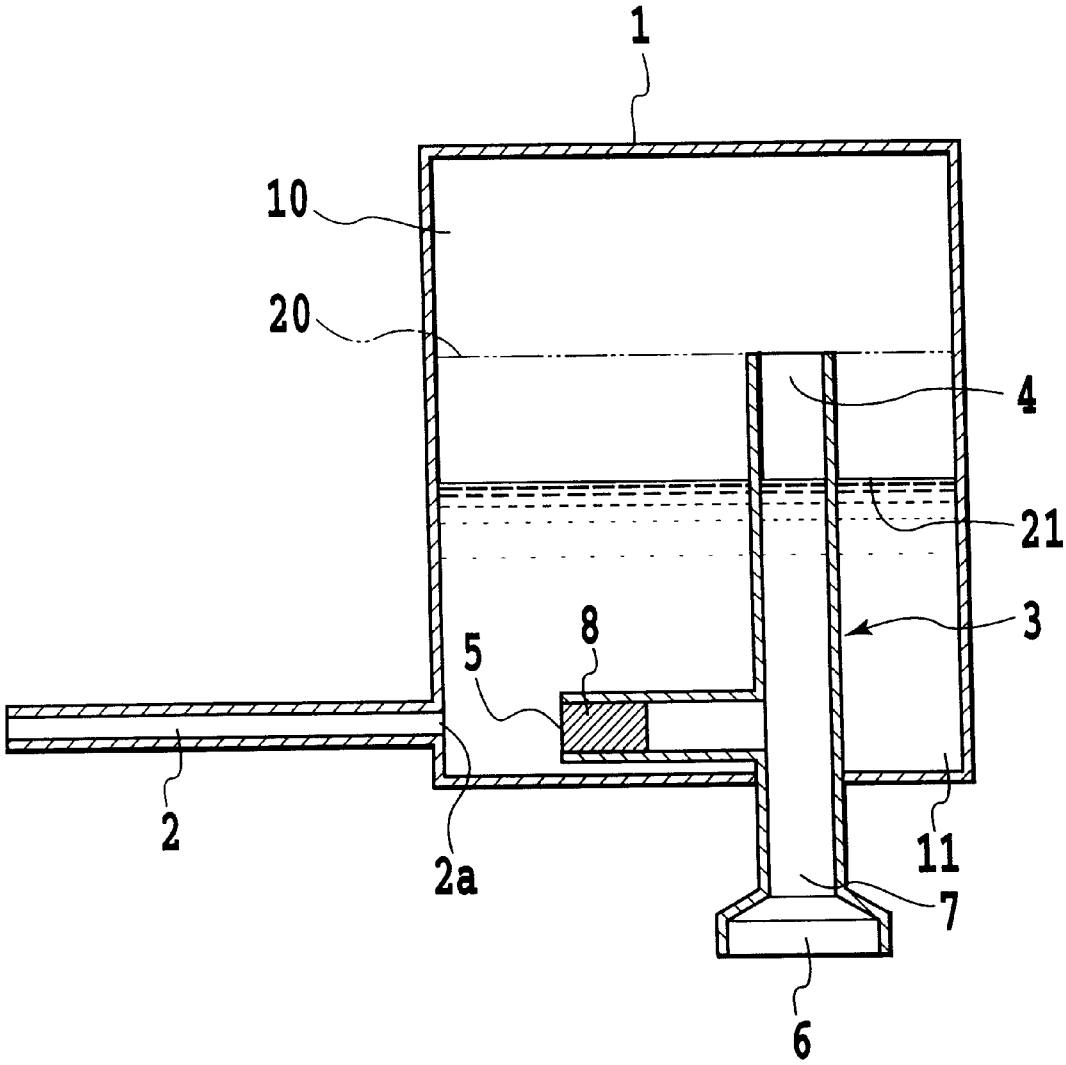
FIG. 2 is a diagrammatic section showing a construction of the first embodiment of an air buffering vessel of the ink-jet printing apparatus according to the present invention.

FIG. 2 is a diagrammatic section showing a construction of the first embodiment of the air buffering vessel of the ink-jet printing apparatus according to the present invention.

The ink-jet printing apparatus, to which the present invention is applied, has a printing head mounted on the carriage movable for reciprocation in a direction (the foregoing direction A) substantially perpendicular to a feeding direction (foregoing direction B) of the printing medium. By ejecting ink from the nozzles of the printing head onto the printing medium, printing is performed.

It should be noted that the present invention is of course applicable for an ink-jet printing apparatus of the type, in which the printing head is fixed and the printing medium is fed to perform printing on the printing medium by ejecting ink from the printing head with varying relative position between the printing head and the printing medium.

As shown in FIG. 2, the air buffering vessel 1 of the ink-jet printing apparatus according to the present invention, is connected to a printing head 6 via a connection opening 7, and is mounted on the carriage 104. The scanning carriage, on which the air buffering vessel 1 and the printing head 6 are mounted is reciprocally moved along a guide shaft in a direction perpendicular to the feeding direction of the printing medium, similarly to a typical ink-jet printing apparatus. Then, printing is performed by ejecting ink from the printing head 6 on the printing medium.

In such an ink-jet printing apparatus, the air buffering vessel 1 is formed into an enclosed vessel shape by molding of a synthetic resin material, such as plastic, for example. To the air buffering vessel 1, a supply tube 2 for supplying ink is connected at an ink supply opening 2*a*, and the air buffering vessel 1 is connected to the ink storage tank via the supply tube 2.

On the other hand, the air buffering vessel 1 has a member 3 for sucking and discharging air and ink (hereinafter referred to as a communicating member). In the shown embodiment, the communicating member 3 is formed with a T-shaped branching pipe member, and is provided within the air buffering vessel 1. One end of the T-shaped branching pipe is formed as an upper opening serving as an air suction opening 4, another end is formed as a lower opening serving as an ink flow opening 5, and a further end is formed as a connection opening 7 to the printing head 6. The connection opening 7 to the printing head 6 is connected to the printing head 6. The air suction opening 4 is formed at the uppermost end of the communication member 3. A position of the upper opening in the air buffering vessel 1 determines the maximum height of the liquid level 20. Ink in the air buffering vessel 1 is not stored beyond the maximum liquid level height 20. The ink flow opening 5 of the communication member 3 is desirable to provide larger flow resistance in comparison with the air suction opening 4. To this end, it may be possible to provide a filter member 8 as required. In the alternative, the internal diameter of the ink flow opening 5 may be formed with a conduit restricting the flow area in comparison with the air suction opening 4 for providing larger flow resistance. Furthermore, the ink flow opening 5 may be a lateral hole, and the filter member 8 may be a mesh body or a porous body. However, a position of opening of the ink flow opening 5 may be in the vicinity of the lowermost position or in the vicinity of the bottom portion of the air buffering vessel 1, and is desirable to be placed always within the ink.

In the communication member 3 of the air buffering vessel 1, flow resistances against the air and the ink of the air suction opening 4, the supply tube 2 or the ink supply opening 2*a* and the ink flow opening 5 are in turn Ra, Rt and Ri. Then, a relationship among these three flow resistances is desirable to be $Ra<Rt<Ri$.

A difference between an internal volume of the air buffering vessel 1 and an internal volume of the air storing portion 10 is an internal volume of the ink storing portion 11. The ink storing portion 11 is required to certainly provide sufficient ink accumulation capacity and sufficient liquid level height in order to prevent air from flowing out to the printing head by reciprocal motion of the carriage. On the other hand, the air buffering vessel 1 and the printing head 6 reciprocally move together with the carriage for printing. At this time, the ink within the supply tube 2 connected to the air buffering vessel 1 also flows associating therewith. In order to absorb the pressure variation due to associated flow of the ink by elastic property of the air in the air storing portion 10 so as not to transmit pressure fluctuation of the ink in the ink storing portion 11 and the ink within the printing head 6 for enabling printing by stably ejecting the ink, it is required to certainly provide a sufficient volume of the air storing portion 10. What determines the minimum value of the volume of the air storing portion 10 is the maximum liquid level height 20 of the ink storing portion 11.

It should be noted that even when the air in the air storing portion 10 is expanded by elevation of the environmental temperature, since the flow resistance Ri of the ink flow opening 5 is larger than the flow resistance Rt of the supply tube 2, the pressure is relieved toward the supply tube 2. Therefore, the leakage of the ink from the printing head 6 will never be caused.

Next, an adjustment method of the height of the ink liquid level will be explained.

Normally, a flow rate of the ink per a unit time during printing is quite small. Then, the flow resistance of the ink flow opening 5 of the communication member 3 for the ink is small at a quite small flow rate. Therefore, the ink supplied from the supply tube 2 flows only through the ink flow opening 5 in the overall necessary amount for printing, and then flows to the printing head 6 through the connection opening 7 for performing printing. It should be noted that when the ink liquid level is sufficiently high, the air buffering vessel 1 is mounted on the carriage and is moved for printing to cause variation of the liquid level, so that the ink may flow to the printing head 6 even through the air suction opening 4.

The supply tube 2 requires flexibility, and thus it is generally suitable to use a tube made of synthetic resin material. However, as set forth above, a typical tube of synthetic resin material has gas permeability, so that over a long period of time, a penetrating amount of air through the tube wall becomes not ignorable amount. In the alternative, gas dissolved in the ink may generate bubbles. The gas may cause gradual lowering of the liquid level height (shown at 21) by accumulation within the air storing portion 10 of the air buffering vessel 1. Including variation of the liquid level caused by movement of the carriage, when the liquid level height in the air buffering vessel 1 is lowered below the ink flow opening 5, it becomes impossible to feed sufficient amount of the ink to the printing head 6. Accordingly, since ink ejection from the printing head 6 cannot be performed properly, printing failure can be caused.

In order to avoid such conditions, when the ink liquid level in the air buffering vessel 1 becomes the height lower than or equal to the predetermined height, suction is performed at a predetermined flow velocity by a suction pump using the recovery system from the side of the printing head 6. Hereinafter, variation of the ink liquid level will be explained.

Figure 3:
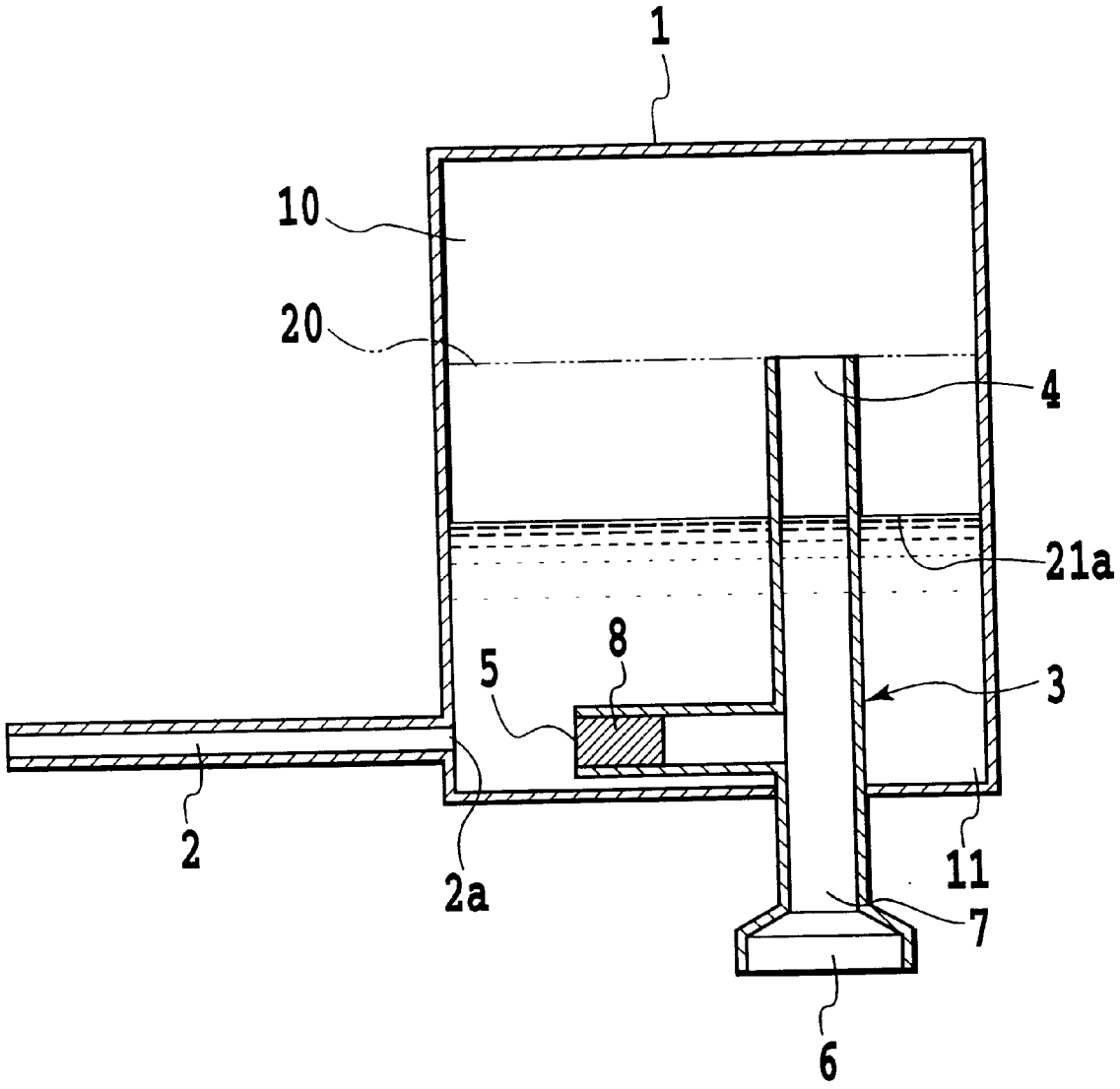
FIG. 3 is a diagrammatic section for explaining variation of an ink liquid level of the air buffering vessel of FIG. 2.
Figure 4:
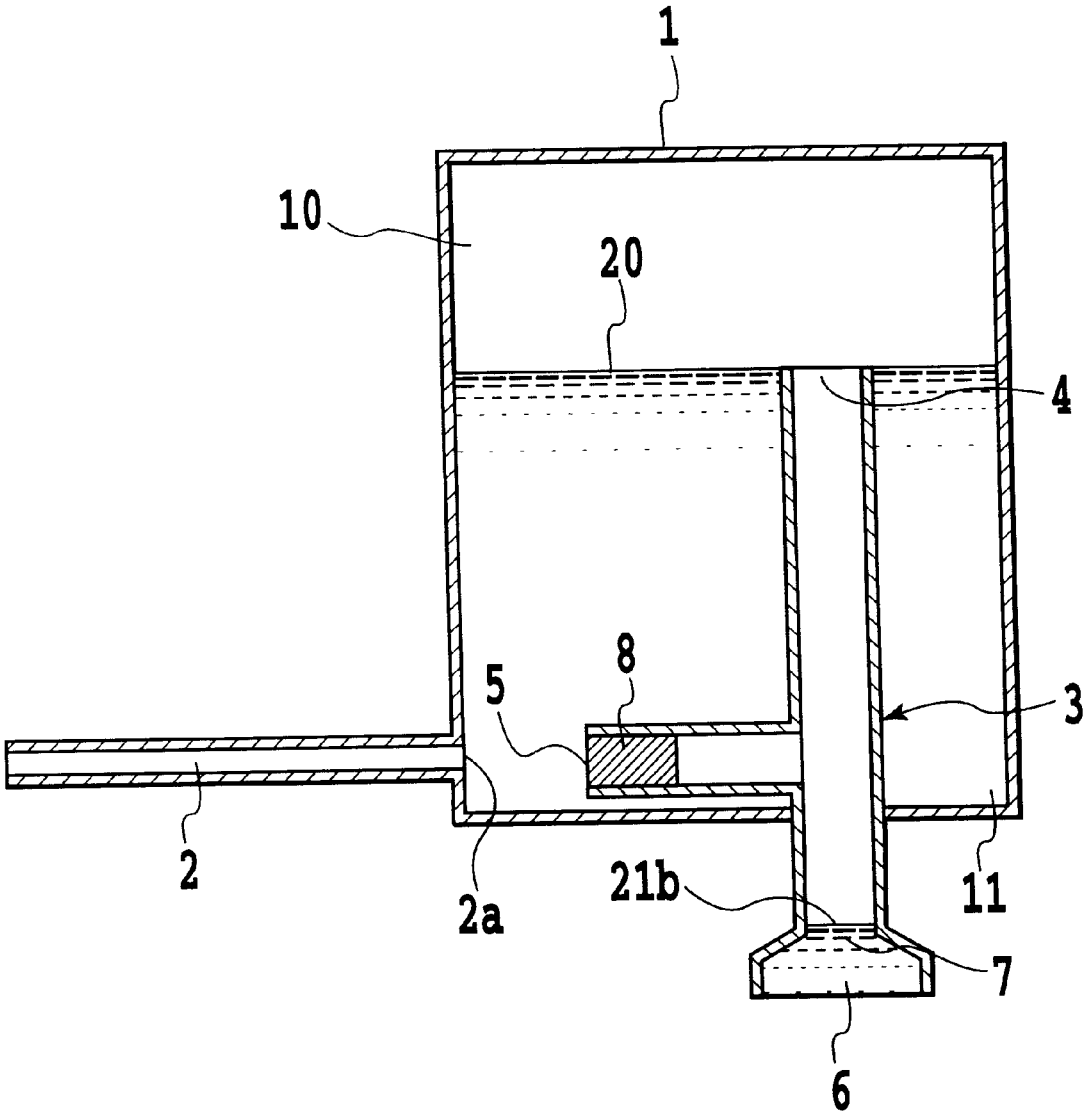
FIG. 4 is a diagrammatic section for explaining variation of the ink liquid level of the air buffering vessel of FIG. 2.

In FIG. 3, before suction by the suction pump, the ink liquid level 21*a* of the ink storage portion 11 and the ink liquid level in the communication member 3 are balanced by communication with the ink flow opening 5 and are the same height. Here, since the relationship of the flow resistances between the air suction opening 4 and the ink flow opening 5 is (Ra<Ri) as set forth above, if suction is performed at greater suction amount (suction speed) than the ink flow rate required upon printing, the condition shown in FIG. 4 is caused. In detail, a difference is caused between the air suction amount in the air suction opening 4 and the ink suction amount in the ink flow opening 5 to introduce large amount of air from the air suction opening 4. Therefore, the ink liquid level in the communication member 3 is lowered abruptly (shown at 21*b* in FIG. 4). It should be noted that when the suction amount is substantially large, it is possible that the ink is not present in the communication member 3. Due to pressure reduction by suction through the printing head from the air buffering vessel 1, ink is supplied from the supply tube 2 for compensating the amount corresponding to reduction of pressure. At this time, since the flow resistance Ri of the ink flow opening 5 is greater than the flow resistance Ra of the air suction opening 4, an amount of the ink flowing through the ink flow opening 5 is small. As a result, the ink liquid level in the air buffering vessel 1 is elevated to the position shown by 20 in FIG. 4 at the highest.

Figure 5:
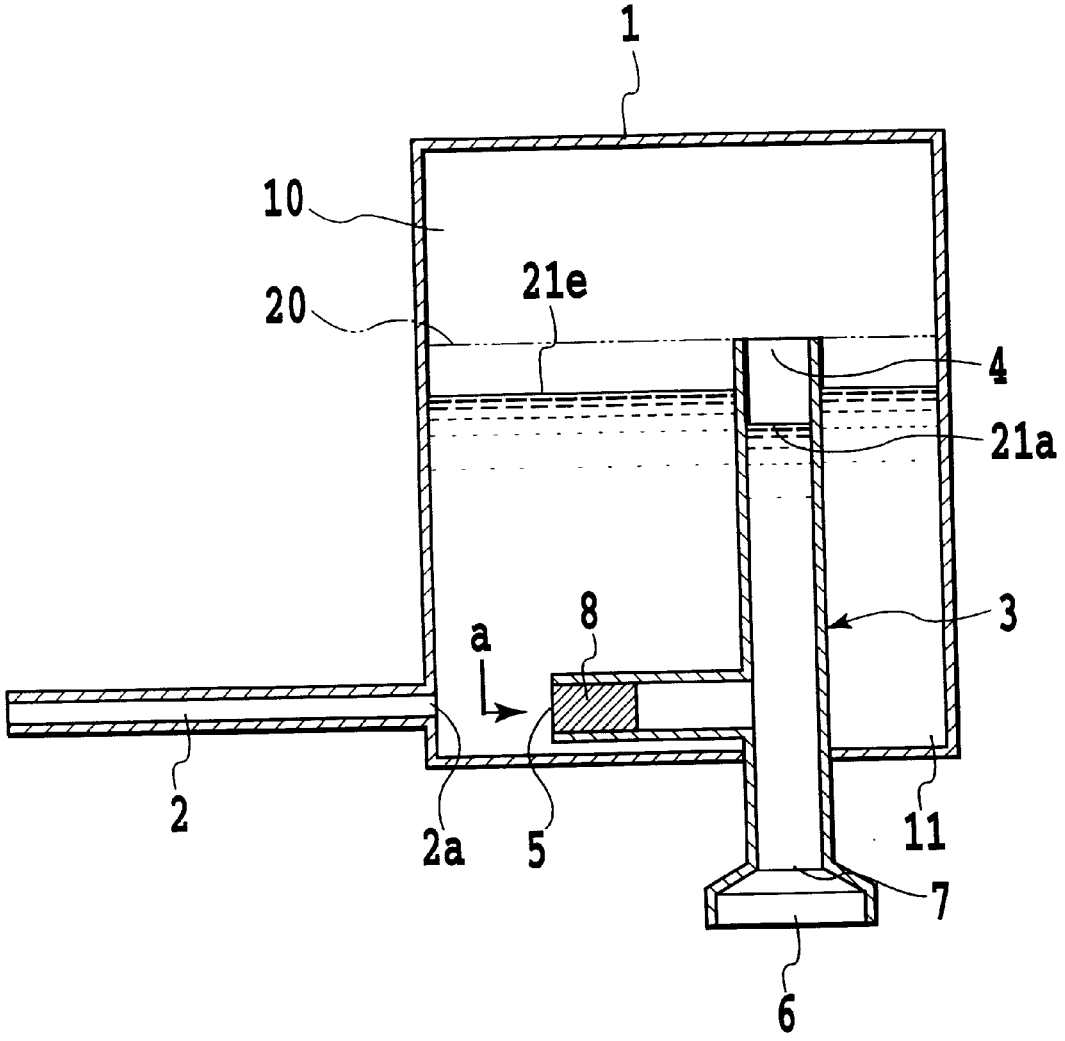
FIG. 5 is a diagrammatic section for explaining variation of the ink liquid level of the air buffering vessel of FIG. 2.

Subsequently, a state when the suction amount by the suction pump is quite small or suction is stopped, is shown in FIG. 5. When the suction amount by the suction pump is quite small or suction is stopped, the pressure in the air buffering vessel 1 is recovered near the atmospheric pressure with supplying the ink from the supply tube 2 for a while for resolving the reduced pressure condition in the air buffering vessel 1. By this, the ink has been elevated up to the liquid level height 20 by sucking the air in the air storing portion 10 through the air suction opening 4 flows into the communication member 3 as shown by arrow a through the ink flow opening 5. At the same time, the air within the communication member 3 is moved toward the air storing portion 10 through the air suction opening 4. As a result, the ink liquid level in the air buffering vessel 1 is lowered from the liquid level height 20 to the liquid level height 21*e*, and also the liquid level within the communication member 3 is elevated from the liquid level height 21*b* to the liquid level height 21*d* so that the air buffering vessel 1 balances as a whole. Accordingly, by the foregoing suction operation, the lowered liquid level in the air buffering vessel 1 can be elevated up to the height which is lowered from the maximum liquid level height 20 by the ink amount corresponding to that required for balancing the lowered liquid level 21 in the air buffering vessel 1 with the ink liquid level in the communication member 3.

Upon suction operation, the suction velocity of the suction pump is higher than the ink flow velocity upon normal printing. At the higher suction velocity, the greater difference between the flow resistances of the air suction opening 4 and the ink flow opening 5 can be obtained, and thus is more effective.

On the other hand, even when the ink flowing into the communication member 3 from the air suction opening 4 blocks a path by surface tension, no problem will be encountered by suction at the pressure overcoming the blocking condition by such surface tension.

(Second Embodiment)

Figure 6:
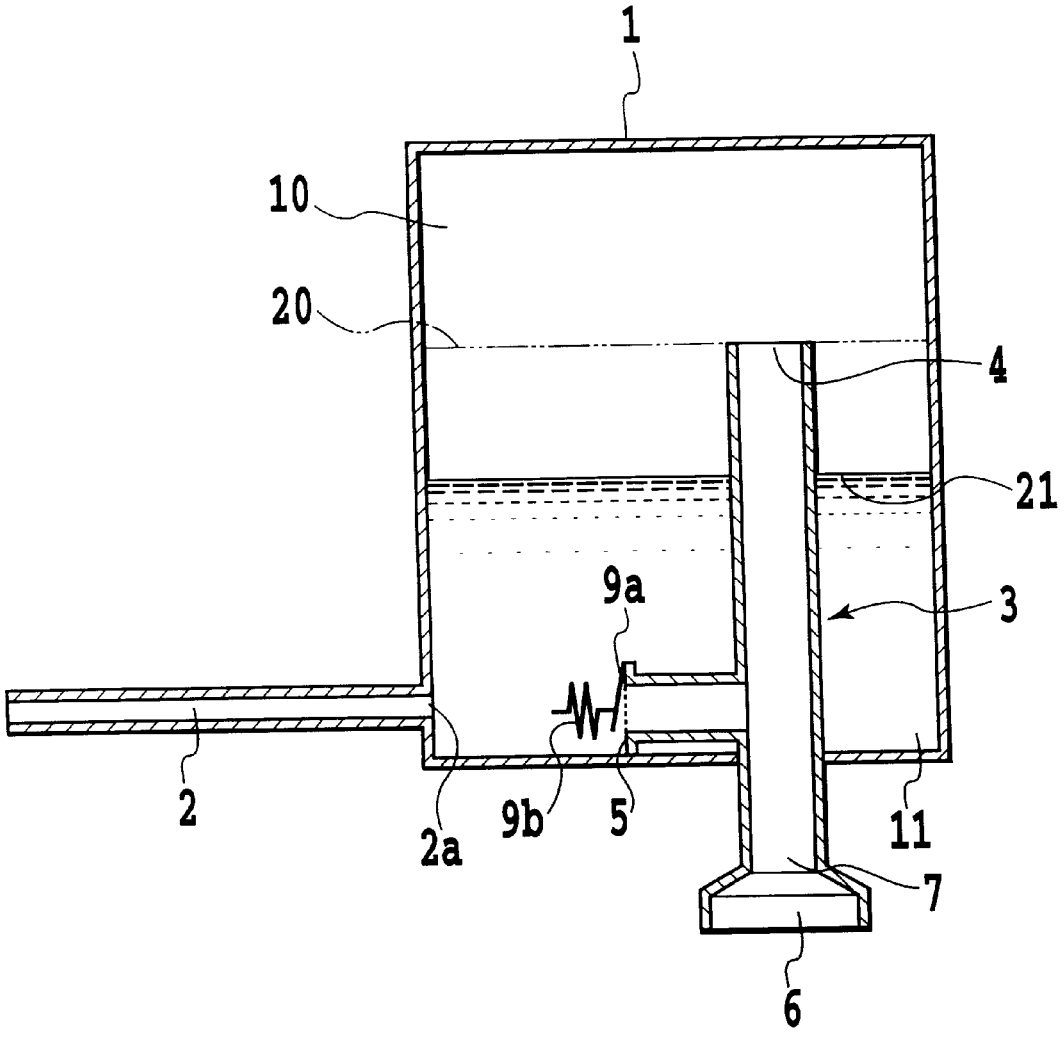
FIG. 6 is a diagrammatic section showing a construction of the second embodiment of the air buffering vessel of the ink-jet printing apparatus according to the present invention.

FIG. 6 is a diagrammatic section of the second embodiment of the air buffering vessel of the ink-jet printing apparatus according to the present invention.

The shown second embodiment is provided with the communication member 3 within the air buffering vessel 1, similarly to the first embodiment set forth above. In the shown embodiment, a movable opening and closing introduction restricting lid 9*a* and an opening and closing control spring 9*b* formed with a spring member having quite small spring constant are provided in the ink flow opening 5 of the communication member 3, in place of the filter member 8. The restricting lid 9*a* is connected to the opening and closing control spring 9*b*. As shown in the drawings, one end of the opening and closing control spring 9*b* is connected to the introduction restricting lid 9*a*, and the other end is secured to an appropriate portion in the air buffering vessel 1. In the steady state, the introduction restricting lid 9*a* is slightly opened to permit flow of fine amount of the ink upon printing through a gap. It should be noted that, even in the shown embodiment, assuming that the flow resistances of the air introduction opening 4, the supply tube 2 or the ink supply opening 2*a*, and the ink flow opening 5 are Ra, Rt and Ri, respectively, the relationship of three flow resistances has to be Ra<Rt<Ri similarly to the first embodiment.

Accordingly, when the ink liquid level in the air buffering vessel 1 is lowered in the magnitude greater than or equal to the predetermined magnitude, the lowered liquid level 21 can be elevated near the maximum liquid level height 20 by performing abrupt suction for larger amount than the ink flow rate during printing. At this time, in the shown embodiment, the suction force becomes greater than tensile force of the opening and closing control spring 9*b* to close the introduction restricting lid 9*a*. Thus, only air is sucked from the air suction opening 4.

Subsequently, by terminating suction, the suction restricting lid 9*a* is opened by the opening and closing control spring 9*b* to be printing enabled state. On the other hand, as a means for opening and closing the suction restricting lid 9*a*, a see-saw type swing pendulum mechanism may be utilized for setting a slightly opened state and a closing force, in place of the opening and closing control spring 9*b*, and thus can achieve similar effect. By this, by appropriately setting a scanning acceleration of the carriage and the mass of the opening and closing mechanism, for example, the ink flow opening 5 is opened only during printing scan and is closed by stopping of the suction restricting lid 9*a* upon adjustment of the liquid level height to provide the foregoing function.

(Third Embodiment)

Figure 7:
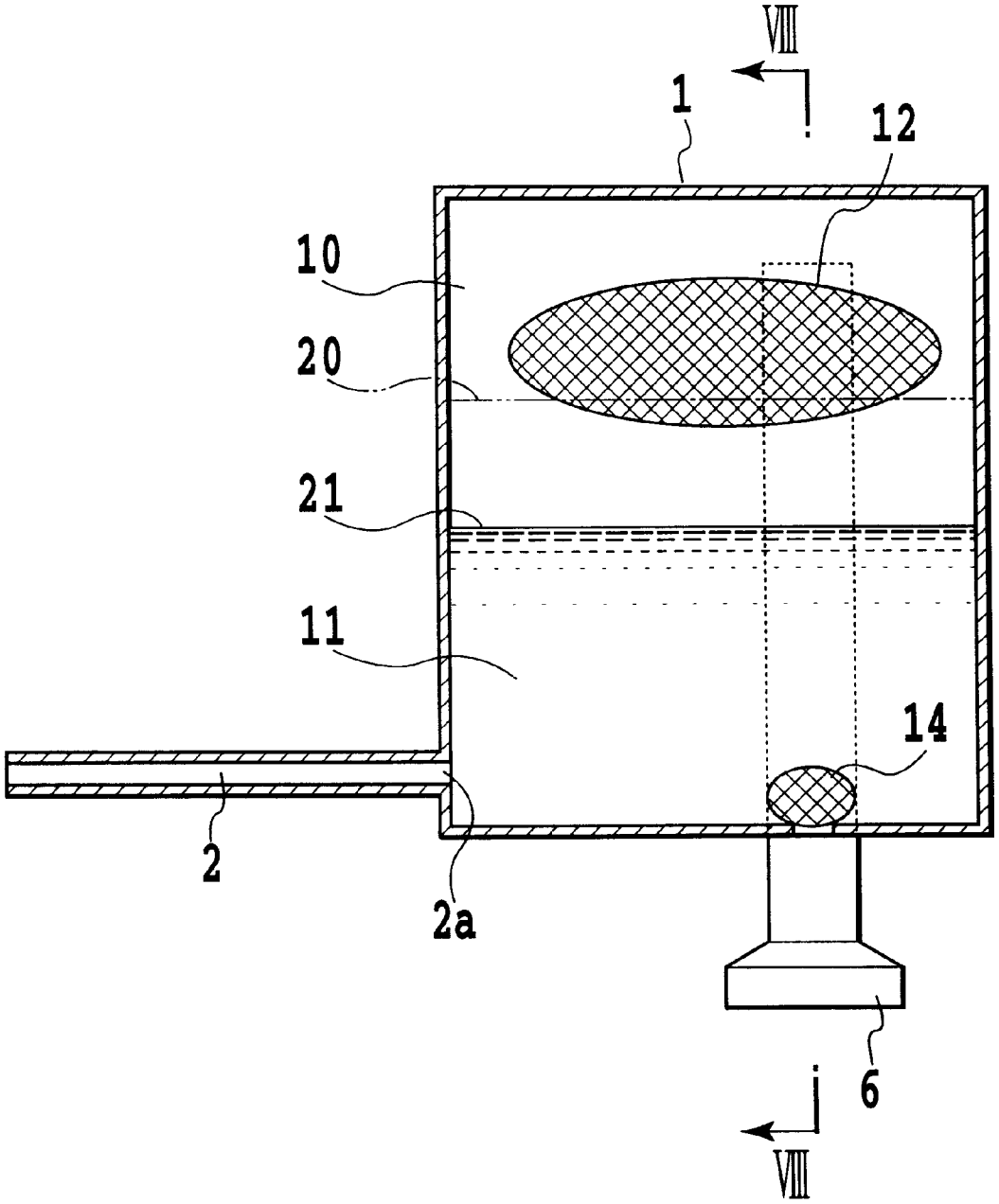
FIG. 7 is a diagrammatic and sectional front elevation showing a construction of the third embodiment of the air buffering vessel in the ink-jet printing apparatus according to the present invention.
Figure 8:
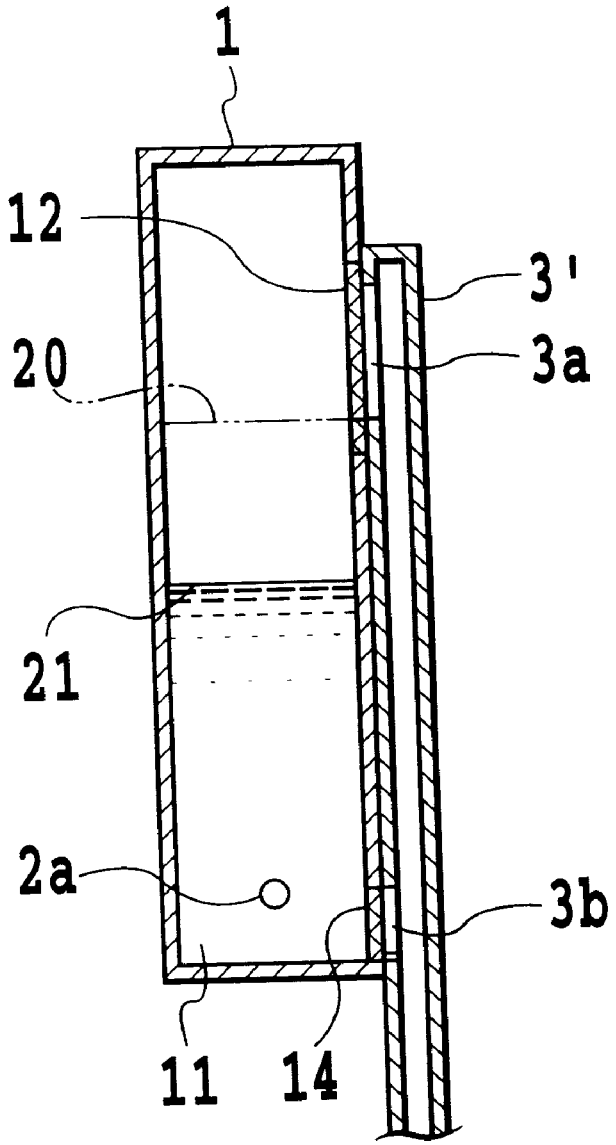
FIG. 8 is a section taken along line 8—8 of FIG. 7.

FIG. 7 is a diagrammatic and sectional front elevation of the third embodiment of the air buffering vessel of the ink-jet printing apparatus according to the present invention, and FIG. 8 is a section taken along line 8—8 of FIG. 7.

As shown, the shown embodiment is provided with a communication member 3' along one external side surface of the air buffering vessel 1. The air buffering vessel 1 and the communication member 3' are communicated by communicating portions 3*a* and 3*b*. Accordingly, the communicating portions 3*a* and 3*b* are formed in such a manner that the upper communicating portion 3*a* communicating between the air buffering vessel 1 and the communication member 3' corresponds to the air suction opening 4 and the lower communicating portion 3*b* corresponds to the lower communication opening, namely the ink flow opening 5. Furthermore, in the lower communicating portion 3*b* corresponding to the ink flow opening 5, a large flow resistance member 14 having large flow resistance is provided. In conjunction therewith, in the upper communicating portion 3*a* corresponding to the air suction opening 4, a small flow resistance member 12 having small flow resistance is provided. In the shown embodiment, as the small flow resistance member 12 and the large flow resistance member 14, the same kind of filter members, such as a wire mesh filter are used. By providing different areas for these small flow resistance member 12 and the large flow resistance member 14, respectively, mutually different flow resistances can be set respectively.

Accordingly, even in the shown embodiment, assuming that the flow resistances of respective of the air suction opening 4, the supply tube 2 or the ink supply opening 2*a* and the ink flow opening 5 are Ra, Rt and Ri, respectively, the relationship of three flow resistances has to be Ra<Rt<Ri similarly to the first and second embodiments set forth above. On the other hand, in order to realize the foregoing relationship, it is possible to form the two or more kinds of the flow resistance members respectively by changing not only the area but also the roughness of the mesh of the filter member.

Further, the flow resistance member may employ a porous member of the metallic member or inorganic member other than the mesh shaped member, such as the filter member or the like set forth above.

As a method for returning the lowered liquid level to the height close to the maximum liquid level height 20, a larger amount of the air is sucked from the small flow resistance member 12 having less suction resistance by performing suction from the side of the printing head 6. The ink is sucked corresponding to the reduced pressure component from the supply tube 2 to rise the liquid level of the ink in the air buffering vessel 1.

Next, modifications of the air buffering vessel will be explained hereinafter with reference to FIGS. 9 to 11.

(First Modification)

Figure 9:
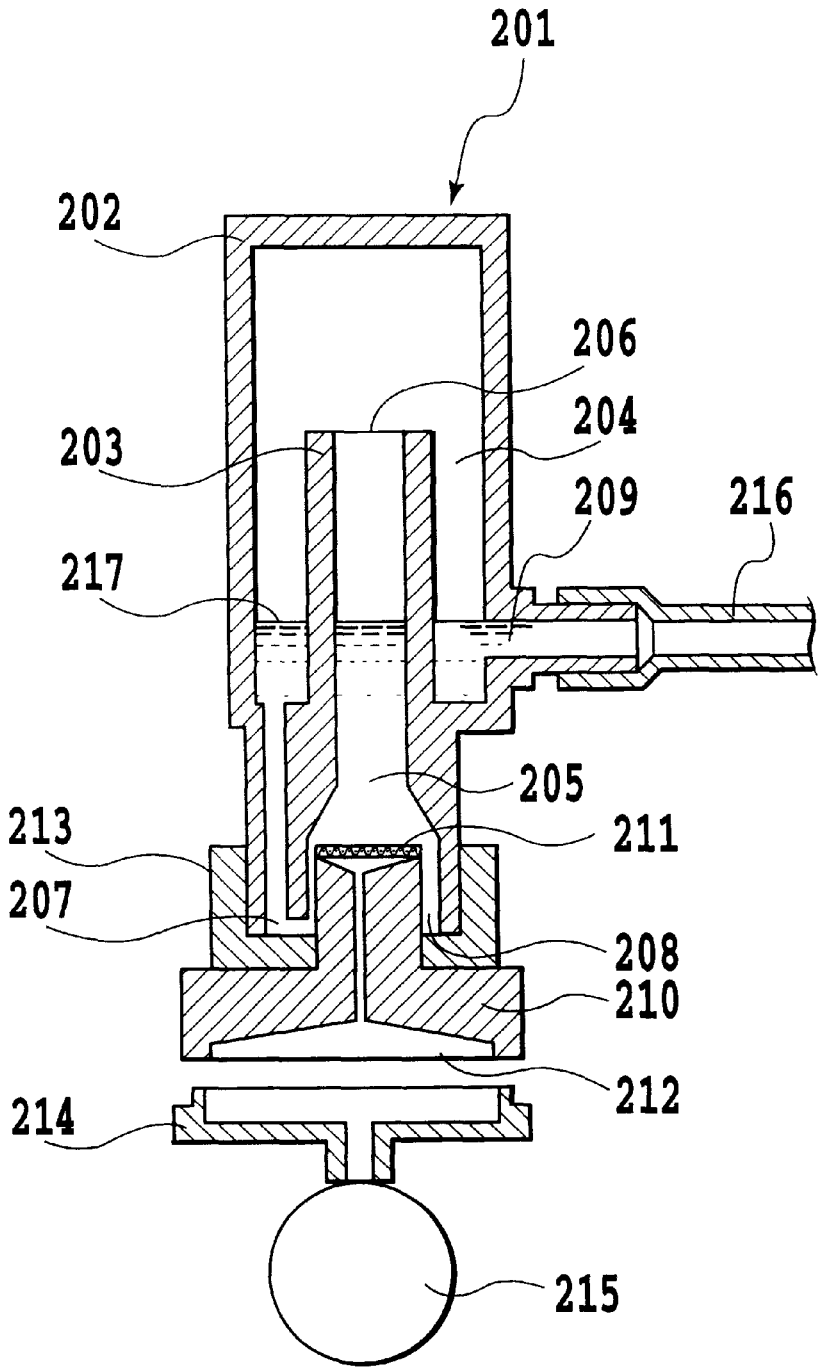
FIG. 9 is a longitudinal section showing of a pressure reduction vessel as the first modification in the inkjet printing apparatus according to the present invention.

FIG. 9 is a diagrammatic section showing a pressure reducing vessel as the first modification of the air buffering vessel in the ink-jet printing apparatus.

As shown in FIG. 9, in the first modification of the ink-jet printing apparatus of the present invention, a pressure reducing vessel 201 is formed with an enclosed vessel body 202, in which a cylindrical wall 203 is formed therein. By the cylindrical wall 203, a first air chamber 204 and a second air chamber 205 are separated. On the uppermost portion of the cylindrical wall 203, a communication opening 206 is provided as an upper communication opening. In the lowermost position of the cylindrical wall 203, an introducing opening 207 is provided as a lower communication opening. By these communication opening 206 and introducing opening 207, the first air chamber 204 and the second air chamber 203 are communicated.

Furthermore, on the vessel body 202 of the pressure reduction vessel 201, a printing head 210 is mounted via a connecting member 213 at the lower portion thereof, and both are mounted on the not shown scanning carriage together. It should be noted that a filter portion 211 of an ink flow path cylinder of the printing head 210 is arranged in the connection opening 208 formed in the bottom portion of the second air chamber 205. Here, in the lower portion of the second air chamber 205, an opening surface, namely a filter surface of the filter portion 211, which is sealingly connected to an end of the ink flow path cylinder, namely the ink flow path opening of the printing head 210, is located at a higher position than the introducing opening 207.

On the other hand, at the intermediate position of the vessel body 202 of the pressure reducing vessel 201, an ink supply opening 209 is provided. The ink supply opening 209 is connected to a not shown stationary or fixed ink storage tank through a supply tube 216. It should be noted that the ink supply opening 209 has to be located at a higher position than the opening surface of the filter portion 211, and arranged within the first air chamber 204.

The printing head 210 mounted on the lower portion of the pressure reducing vessel 201 has a plurality of nozzles 212. Corresponding to the nozzles 212, a head cap 214 is arranged at the home position. To the head cap 214, a pressure reduction pump 215 is connected.

Next, printing operation in the ink-jet printing apparatus of the present invention including the pressure reducing vessel 201 constructed as set forth above, will be discussed hereinafter.

In the ink-jet printing apparatus according to the present invention, the ink is filled up to a liquid level 217 in the pressure reducing vessel 201 upon printing. When the ink is ejected from the nozzles 212 of the printing head 210 mounted on the not shown carriage, the ink in amount corresponding to the ejected amount is filled from the pressure reducing vessel 201 to the printing head 210 through the filter portion 211. Furthermore, reduced amount of the ink in the pressure reducing vessel 201 is filled from the not shown externally fixed ink tank through the supply tube 216. By this, the liquid level 217 before printing can be maintained.

On the other hand, to the head cap 214 opposing to the nozzles 212 of the printing head 210, the pressure reduction pump 215 is connected. When plugging or other failure is caused in the nozzles 212 of the printing head 210, suction recovery of the nozzles 212 of the printing head 210 can be performed by fitting the head cap 214 onto the printing head 210 at the home position and driving the pressure reduction pump 215.

When the printing apparatus is maintained without performing printing for a long period, bubbles may be accumulated within the pressure reducing vessel 201 due to penetration of the air through the wall of the supply tube 216 and generation of bubbles by the air dissolved in the ink. Every time of passing the bubbles across the pressure reducing vessel 201 by printing operation, bubbles are accumulated within the pressure reducing vessel 201. As a result, the liquid level 217 within the pressure reducing vessel 201 is gradually lowered to finally cause penetration of air into the nozzles 212 of the printing head 210 from the filter portion 211 resulting in possible printing failure.

In order to return the liquid level in the pressure reducing vessel 201 to the original liquid level 217 from this condition, the pressure reducing vessel 201 is reduced in pressure by means of the pressure reduction pump 215. This return operation utilizes suction time difference to be caused due to differences of ink suction and air suction speed. Hereinafter, the detail will be explained.

At first, a resistance of the ink supply opening 209 of the pressure reducing vessel 201 is set. A suction resistance against the air of the printing head 210 is mainly a sum of resistances of the filter portion 211 and the nozzles 212. This suction resistance against the air is set to be lower than or equal to a suction resistance against the ink in the ink supply opening 209. Upon setting of the suction resistance against the ink in the ink supply opening 209, it may be possible to arrange a filter member. Alternatively, an internal diameter of the ink supply opening 209 may be significantly restricted. In the further alternative, suction resistance against the ink may be achieved even by restricting an internal diameter of the supply tube 216 connected to the ink supply opening 209. Judging from the ink supply velocity upon normal printing, an appropriate restricting internal diameter may be greater than or equal to 0.5 mm and less than or equal to 2 mm. When the diameter is less than 0.5 mm, shorting in supply of the printing ink may be caused. The diameter is greater than 2 mm, pressure reducing effect can be lowered.

It should be noted that, in the case of the general ink-jet printing head, the filter portion 211 is 8 $\mu$m mesh and is circular shape having an external diameter in a range of about 3 mm to about 10 mm. The nozzle 212 is a fine ejection opening of about 10 $\mu$m to 30 $\mu$m diameter. About fifty to six hundreds nozzles are arranged in an array fashion.

Next, when the pressure reducing pump 215 is driven for a predetermined period of time, a residual ink is sucked out through the head cap 214 in pressure contact with the nozzles 212 to remove air within the printing head 210, permitting air to pass through. As a result, the air within the pressure reducing vessel 201 is abruptly drawn out. However, the large suction resistance against the ink of the ink supply opening 209 is cooperated with inertia of the ink per se to take a long period for suction of the ink. As a result, the internal pressure of the pressure reducing vessel 201 abruptly become negative pressure. As pressure reducing conditions at this time, while it is associated with the volume of the pressure reducing vessel 201, an appropriate range of the volume of the pressure reducing vessel 201 is 1 cc to 10 cc. As an air suction amount of the pressure reducing pump 215, it is required to suck out the air at least more than or equal to 10% of the volume of the pressure reducing vessel 201 within 10 seconds.

In a result of experiments of the shown embodiment, good result was attained under a condition where 25% of air of the pressure reducing vessel 201 in a volume of 5 cc is sucked out within a range of 3 seconds to 5 seconds.

Subsequently, after abrupt pressure reduction, the ink enters into the pressure reducing vessel 201 with a lag. The introducing opening 207 as the lower communication opening of the first air chamber 204 and the second air chamber 205 is narrow to have large flow resistance, and the upper communication opening 206 of the second air chamber 205 has the large opening portion to have smaller resistance, an air suction amount from the upper communication opening 206 becomes large. As a result, a little amount of the ink flows through the introducing opening 207 transitionally. At first, the ink to be filled by pressure reduction is accumulated in the first air chamber 204.

Finally, when driving of the pressure reducing pump 215 is terminated and the internal pressure of the pressure reducing vessel 201 becomes close to the initial internal pressure by suction of the ink from the ink supply opening 209, the ink flows into the second air chamber 205 through the introducing opening 207 to establish balance between the first air chamber 204 and the second air chamber 205. Then, the liquid level is recovered to the initial liquid level 217. The flow of the ink upon balancing of liquid level becomes a flow like upwelling from the lower side with respect to the filter portion 211. Therefore, air bubbles to be retained in the vicinity of the filter portion 211 by surface tension or the like can be peeled out the wall surface or the filter surface to enable complete filing of the ink in the vicinity of the filter portion 211.

On the other hand, a dimension of the upper communication opening 206 is preferably greater than or equal to 2 mm in diameter to enable quick suction of the air. Further, an arrangement position of the upper communication opening 206 is particularly preferable in the vicinity of the uppermost portion of the vessel body 202 where the ink is difficult to pass, and is distanced for more than or equal to 2 mm from the upper inner wall of the vessel body 202 where skin formation due to surface tension with the vessel body 202 is hardly caused.

(Second Modification)

Figure 10:
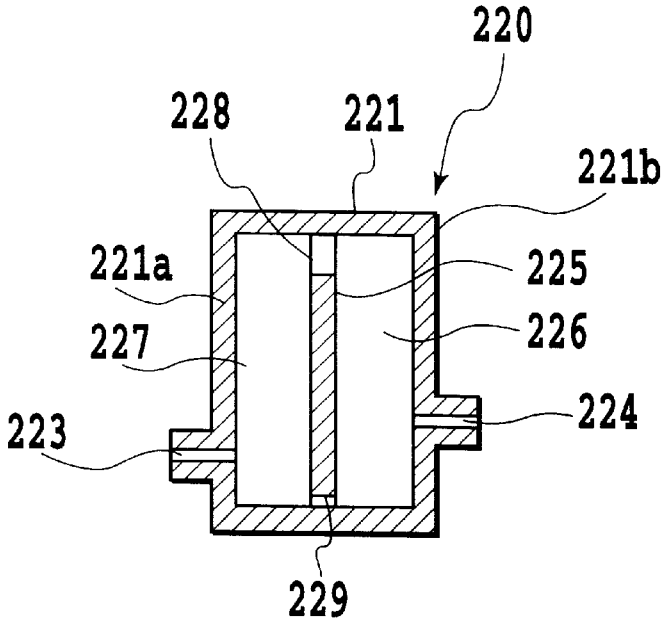
FIG. 10 is a longitudinal section showing a pressure reduction vessel as the second modification in the ink-jet printing apparatus according to the present invention.
Figure 11:
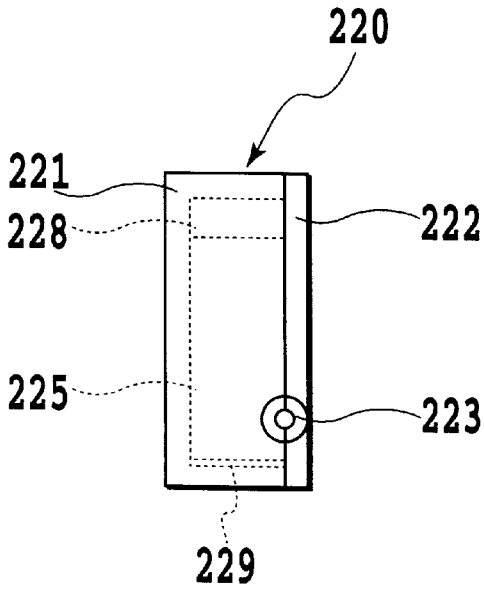
FIG. 11 is a side elevation of the pressure reduction vessel of FIG. 10.

FIGS. 10 and 11 are a longitudinal section and a side elevation showing the pressure reduction vessel as the second modification in the ink-jet printing apparatus according to the present invention.

As shown, the pressure reducing vessel 220 of the shown embodiment of the ink-jet printing apparatus is formed with a rectangular pallalelpiped box shaped vessel body 221 with opening one side and a side lid 222 sealingly closing one side of the opening of the vessel body 221. A connection opening 223 for connection with the printing head is provided in one end wall 221*a* of the box shaped vessel body 221. An ink supply opening 224 connected to the ink storage tank is provided in the other end wall 221*b*. Furthermore, the connection opening 223 is located at lower position than the ink supply opening 224.

On the other hand, a partition 225 is provided within the vessel body 221 of the pressure reducing vessel 220. By the partition 225, a first air chamber 226 and a second air chamber 227 are separated. Furthermore, a communication opening 228 as an upper communication opening is formed in the upper portion of the partition 225 mating with the inner surface of the vessel body 221. Similarly, the lower portion of the partition 225 mating with the inner surface of the vessel body 221 is provided with the introducing opening 229 as the lower communication opening. By the communication opening 228 and the introducing opening 229, the first air chamber 226 and the second air chamber 227 are communicated with each other.

The former first modification is constructed generally cylindrical shape as a whole by forming the second air chamber 205 by the cylindrical wall 203 adapting to the shape of the filter portion 211 of the printing head 210 and the pressure reducing vessel 201 is connected integrally with the printing head 210. In contrast to this, the feature of the shown second modification is constructed in that the printing head and the shown embodiment of the pressure reducing vessel 220 are formed separately and the printing head and the connection opening 223 of the pressure reducing vessel 220 are connected by not shown tube or the like. Accordingly, with such construction, it becomes possible to freely select the shape of the pressure reducing vessel to facilitate formation even under constraint in shape of other parts.

It should be noted that since the function of the shown pressure reducing vessel 220 is the same as the foregoing pressure reducing vessel 201, redundant disclosure is avoided.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording. U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink-jet printing apparatus comprising:

means for printing on a printing medium by ejecting an ink from a printing head with varying relative position between said printing head and said printing medium by either of scanning said printing head or feeding said printing medium;

an ink storage tank disposed at a position not being interfered by scanning of said printing head or feeding of said printing medium;

a pressure reducing vessel connected to said printing head; and means for supplying the ink to said printing head from said ink storage tank through said pressure reducing vessel, wherein said pressure reducing vessel has at least two air chambers mutually communicated by an upper communication opening and a lower communication opening, an ink supply opening from said ink storage tank and a connection opening to said printing head are respectively arranged in different air chambers of said at least two air chambers, said ink supply opening is located at a position lower than said upper communication opening and higher than said connection opening, and ink suction resistances of said lower communication opening and said ink supply opening are set to be greater than an air suction resistance of said upper communication opening.

2. An ink-jet printing apparatus as claimed in claim 1, further comprising a portion having an internal diameter less than or equal to 2 mm within a path from said ink storage tank through said pressure reducing vessel, and wherein an opening area of said upper communication opening is greater than or equal to 3.1 $mm^2$.

3. An ink-jet printing apparatus as claimed in claim 1, wherein said lower communication opening of said pressure reducing vessel is arranged at lower position than said connection opening or an ink flow opening of a member connected thereto.

4. An ink-jet printing apparatus as claimed in claim 1, wherein said pressure reducing vessel is constructed with a vessel body having an enclosed interior separated into a first air chamber and a second air chamber, said upper communicating opening is provided at the uppermost position of said first air chamber and said lower communication opening is provided at the lowermost portion of said first air chamber, and said printing head is mounted on the lower portion of said vessel body.

5. An ink-jet printing apparatus as claimed in claim 4, wherein said printing head has nozzles, a head cap is arranged opposing to said nozzles at a home position, and said head cap is connected to a pressure reduction pump.

6. An ink-jet printing apparatus as claimed in claim 1, wherein said pressure reducing vessel is constructed with a vessel body separated into a first air chamber and a second air chamber by a cylindrical wall formed therein, said upper communication opening is formed at the uppermost portion of said cylindrical wall and said lower communication opening is formed at the lowermost portion, said ink supply opening opened to said first air chamber is provided at an intermediate position of said vessel body, and said connection opening is formed in the bottom portion of said second air chamber, said printing head is mounted on the lower portion of said vessel body via a connection member in a condition where a filter portion of said printing head is arranged in said connection opening.

7. An ink-jet printing apparatus as claimed in claim 1, wherein said pressure reducing vessel is constructed with a vessel body separated into a first air chamber and a second air chamber by a partition member formed therein, said upper communicating opening is provided at an upper portion of said partition member and said lower communication opening is provided at a lower portion of said partition member, said ink supply opening is provided in said first air chamber and said connection opening is provided in said second air chamber.

* * * * *

UNITED STATES PATENT AND TRADEMARK OFFICE

CERTIFICATE OF CORRECTION

PATENT NO. : 6,325,496 B1
DATED : December 4, 2001
INVENTOR(S) : Tetsuto Kageyama et al.

It is certified that error appears in the above-identified patent and that said Letters Patent is hereby corrected as shown below:

Title page,
Item [57], ABSTRACT,
Line 9, “height” should read -- heights --; and “Upper” should read -- An upper --; and
Line 11, “Lower” should read -- A lower --.

Column 1,
Line 30, “an” should read -- in an --.

Column 2,
Line 17, “ends” should read -- end --; and
Line 28, “complicate,” should read -- complicated, --.

Column 3,
Line 18, “that” should read -- that when --.

Column 4,
Line 49, “pertition” should read -- partition --;
Line 50, “pertition” should read -- partition --; and
Line 58, “transducer. 18.” should read -- transducer. ¶ --

Column 5,
Line 3, “to be” should be deleted;
Line 27, “whether is” should read -- of whether --; and
Line 50, “an” should read -- a --.

Column 6,
Line 3, “the” should read -- to the --;
Line 38, “of” should be deleted;
Line 39, “inkjet” should read -- ink-jet --;
Line 48, “EMBODIMENT” should read -- EMBODIMENTS --;
Line 49, “embodiment” should read -- embodiments --; and
Line 67, “for” should read -- is for --.

Column 10,
Line 18, “flows” should read -- and flows --.

Column 11,
Line 53, “these” should read -- the --.

UNITED STATES PATENT AND TRADEMARK OFFICE

CERTIFICATE OF CORRECTION

PATENT NO. : 6,325,496 B1
DATED : December 4, 2001
INVENTOR(S) : Tetsuto Kageyama et al.

It is certified that error appears in the above-identified patent and that said Letters Patent is hereby corrected as shown below:

Column 12,
Line 28, “these” should read -- the --; and
Line 30, “chamber 203” should read -- chamber 205 --.

Column 13,
Line 33, “detail” should read -- details --;
Line 52, “The” should read -- When the --; and
Line 59, “hundreds” should read -- hundred --.

Column 14,
Line 3, “become” should read -- becomes --; and
Line 59, “pallalelpiped” should read -- parallelepiped --.

Column 16,
Line 19, “consists” should read -- consist --.

Column 17,
Line 29, “with varying” should read -- while varying the --; and
Line 34, “by” should read -- with by --.

Column 18,
Line 10, “at” should read -- at a --; and
Line 37, “is” should read -- being --.

Signed and Sealed this

Sixteenth Day of July, 2002

*Attest:*

*Attesting Officer*

JAMES E. ROGAN
*Director of the United States Patent and Trademark Office*